US005942961A

United States Patent [19]

Srail et al.

[11] Patent Number: 5,942,961

[45] Date of Patent: Aug. 24, 1999

[54] MAGNETIZED MATERIAL HAVING ENHANCED MAGNETIC PULL STRENGTH AND A PROCESS AND APPARATUS FOR THE MULTIPOLAR MAGNETIZATION OF THE MATERIAL

[75] Inventors: Raymond Charles Srail, Parma; Richard August Glover, Brookpark; Thomas Raymond Szczepanski, North Royalton; Eric Martin Weissman, Chagrin Falls; Frederic William Kunig, Akron, all of Ohio

[73] Assignee: Flexmag Industries, Inc., Marietta, Ohio

[21] Appl. No.: 08/407,963

[22] Filed: Mar. 22, 1995

Related U.S. Application Data

[62] Division of application No. 08/249,668, May 26, 1994, Pat. No. 5,428,332, which is a continuation of application No. 07/869,414, Apr. 14, 1992, abandoned.

[51] Int. Cl.[6] ..... H01F 7/20

[52] U.S. Cl. ..... 335/284; 335/285; 335/302; 335/306

[58] Field of Search ..... 335/284, 285, 335/302, 306

[56] References Cited

U.S. PATENT DOCUMENTS

| | | | |
|---|---|---|---|
| Re. 34,229 | 4/1993 | Shimizu | 335/302 |
| 3,117,065 | 1/1964 | Wootten | 335/284 |
| 3,127,544 | 3/1964 | Blume, Jr. | 335/284 |
| 3,317,872 | 5/1967 | Wullkopf | 335/284 |
| 3,409,853 | 11/1968 | Guerth | 335/284 |
| 3,624,572 | 11/1971 | Mallinson | 335/209 |
| 3,629,756 | 12/1971 | Holtz | 335/285 |
| 4,126,567 | 11/1978 | Otera | 252/62.54 |
| 4,379,276 | 4/1983 | Bouchara et al. | 335/284 |
| 4,399,422 | 8/1983 | Nelson | 335/284 |
| 4,682,137 | 7/1987 | Kasza | 335/284 |
| 5,002,677 | 3/1991 | Srail | 252/62.54 |
| 5,171,652 | 12/1992 | Umetani | 430/102 |
| 5,200,729 | 4/1993 | Soeda | 335/284 |
| 5,424,703 | 6/1995 | Blume, Jr. | 335/284 |
| 5,428,332 | 6/1995 | Srail et al. | 335/302 |

FOREIGN PATENT DOCUMENTS

| | | |
|---|---|---|
| 0 218 044 | 8/1986 | European Pat. Off. . |
| 0 218 044 | 4/1987 | European Pat. Off. . |
| 93 91 0589 | 1/1995 | European Pat. Off. . |
| 1121773 | 7/1968 | United Kingdom . |
| PCT/US93/03446 | 7/1993 | WIPO . |

*Primary Examiner*—Lincoln Donovan
*Assistant Examiner*—Tuyen T. Nguyen
*Attorney, Agent, or Firm*—Hudak & Shunk Co., L.P.A.

[57] ABSTRACT

A process and apparatus for permitting the magnetization of flexible hard magnetic materials in the form of sheets or strips, such as magnetic rubber, wherein opposing arrays formed from alternating magnetic disks and flux conducting elements are use in sets of two with opposing polar moments such as to induce a magnetic flux in the gap between the discs. The width of the magnetic disk and flux conducting elements, respectively, are selected to optimize the magnetic pull strength of the material. At the array ends are flux conducting elements that are about ½ (i.e., from about 0.25 to about 0.75, and preferably from about 0.4 to 0.6) of the width of the internal flux conducting elements. A material to be magnetized is passed between the array sets in contrast with both disks and consequently imprinted with magnetic poles. The magnetized properties of the material is enhanced by passing the material through a second set of arrays which are axially offset with respect to the first set of arrays. This enhances the residual induction of the sample, the shape of the $Br^2$ versus distance curve, and significantly improves the pull strength of the material. A device is provided for the production of the material, and further can be used without modification to imprint non-traversing magnetization by biasing the material to one of the arrays of the second, i.e. exiting, set of arrays.

11 Claims, 10 Drawing Sheets

MAGNETIZED MATERIAL HAVING ENHANCED MAGNETIC PULL STRENGTH AND A PROCESS AND APPARATUS FOR THE MULTIPOLAR MAGNETIZATION OF THE MATERIAL

CROSS-REFERENCE

This is a division of application Ser. No. 08/249,668, filed on May 26, 1994, of Raymond Charles Srail; Richard August Glover; Thomas Raymond Szczepanski; Eric Martin Weissman; and Frederic William Kunig, for "Magnetized Material Having Enhanced Magnetic Pull Strength and a Process and Apparatus for the Multipolar Magnetization of the Material," now U.S. Pat. No. 5,428,332, which was a file-wrapper continuation of Ser. No. 07/869,414, filed Apr. 14, 1992, abandoned.

FIELD OF INVENTION

The present invention relates to an apparatus and process for effecting a multipolar magnetization of a material which is preferably a flexible magnetizable material in the form of sheets or strips of the magnetic rubber type. The invention further relates to a magnetized material resulting from the process which has enhanced magnetic pull strength.

BACKGROUND

It is known to imprint magnetic poles of alternating polarity on the surface of material by causing the material to travel in the immediate vicinity of the active portion of a magnetizing apparatus or in the air gap of such an apparatus producing an adequate magnetic field. The multipolar magnetization obtained on the material can be of the traversing or symmetrical type, which means that the two faces of the strip or of the sheet exert a magnetic attraction or pull strength of approximately the same value. On the other hand, it can be of a non-traversing or biased type and, in this case, one of the faces of the material exerts a biased or higher magnetic pull strength than the other face. The weaker or magnetically unbiased face may be advantageous for other uses and is able to receive, for example, some decoration, paint or an adhesive, or alternatively a sheet of mild magnetic material.

In order to magnetize a material, it is necessary to apply an adequate magnetic field to it, the intensity of which depends on the magnetic intrinsic coercive force of the material (and the direction of which depends on the field lines to be imprinted in this material). Typically the intensity of the applied flux field should be at least two times the intrinsic coercive force (Hci) of the material, and more particularly should be three or more, the general rule being that a magnetic field three times the value of the material Hci being necessary to achieve saturation magnetization.

In accordance with the prior art, magnetic fields are produced by direct, optionally pulsed electric currents by using, for example, electromagnets, coils (solenoids) or the discharge of capacitors.

These systems are essentially intended for single face magnetization. Nevertheless, they are expensive as they are complex, often fragile, subject to heating up and are high energy consumers and can be dangerous. They are limited in the number of poles per inch and in possible active surfaces due to problems of insulation of the conductors and the electromagnetic stresses applied to them. Moreover, the production rates are frequently limited to a strip speed of less than 3 m/min or about 10 ft/min, and even much less in the case of double face multipolar magnetization (i.e., transverse type).

Alternatively, in the prior art, the magnetic field may be produced by permanent magnets, in which case, the following benefits are obtained:

- very low energy consumption limited to the mechanical energy needed for extracting the magnetized material from the apparatus,
- high reliability in operation,
- high safety in use due to absence of high voltage, the elimination of internal stresses in the apparatus. However, the main disadvantages of systems using Alnico or ferrite type permanent magnets are:
  - the production of a relatively weak magnetic field resulting in difficulty of effecting magnetization of moderately coercive materials, and the difficulty in obtaining the multipolar magnetization of magnetic materials in sheet form as described above.

One method of multipolar magnetization is set forth in U.S. Pat. No. 4,379,276 to Bouchara et al. which relates to a process and apparatus for permitting the magnetization of materials in the form of sheets or strips, such as magnetic rubber, wherein, a strip to be magnetized travels between stacks formed by a plurality of flat main magnets each of which is intermediate to flux conducting pole elements. The main magnets are magnetized through the thickness. The magnets and flux conducting pole elements are alternately stacked in axial alignment to form a cylindrical stacked array. The magnetic disks are aligned between the flux conducting pole elements and with the disks having opposing (i.e., mirror image) magnetizations with a flux conducting pole element located in between. Accordingly, a polar moment (North or South) is induced at the surface of the flux conducting pole element, and when two arrays are positioned with opposing opposite polar moments, the induced polar moment is enhanced. Preferably, these arrays have magnetic disks of equal thickness and flux conducting pole elements of equal thickness, and further the arrays are of the same size so that each induced pole has an opposing and opposite polar moment. It is believed that this configuration facilitates a flux circuit whereby the flux passes across a flux gap between the induced polar moments from the cylindrical surface of one array to the other in a first direction, through an adjacent magnetic disk in the direction of magnetization, across to the next array in a second direction opposite the first direction, and through a second magnetic disk to the first flux conducting element. When the pre-magnetized material is subjected to the flux circuits of the flux gap, the material is magnetized, i.e., one or more field lines are imprinted on the material. In the case of multipolar magnetization, the sample is polarized, i.e., is magnetized with alternating north and south poles.

SUMMARY OF THE INVENTION

The present invention relates to a device and process for the magnetization of materials preferably in sheets or strips which overcomes all the above-mentioned disadvantages, in which the magnetic field is created by permanent magnets capable of magnetizing moderately coercive materials by imprinting very carefully controlled (i.e., poles having a controlled shape and location) multipolar magnetization and of permitting a very high speed of travel of material. The invention further relates to the magnetized product.

The device of the present invention utilizes more than one set of stacks or arrays of circular magnetic disks and circular flux conducting pole elements, i.e., permendurs. In each array, the magnetic disks are magnetized through the thickness and are aligned between permendurs. In each array, the magnetic disks are situated with opposing like poles, with a pole to pole distance (including one disk and one flux conducting pole element) as defining one pole space. This distance determines the characteristics of the magnetic imprint on the magnetized material and the pole spacing will preferably be selected such that the thickness of the sheet or strip material, is less than one pole spacing. As the "gap" becomes greater than the pole spacing, the preferred "across the gap" flux circuit with the facing opposite pole from the second array now has competition with the opposite pole from the same array on its surface and much lower effective flux in the across the gap (thickness of material magnetized) direction is observed. The alignment of the magnetic poles of the magnetic disks induces a radial flux in the flux conducting pole element such that a polar moment or pole at the circumference in induced. More precisely, the pole is induced at both the outer and inner circumferences if a washer type flux conductor is used, although the flux is mostly induced at the outer circumference of the flux conducting washers. The flux is induced in a direction perpendicular to the direction of magnetization of the main magnetic disks. Accordingly, the array has alternating poles of flux at the circumference of the flux conducting elements. One array is aligned opposing a second array having opposite poles in alignment to form one set of arrays.

In order to magnetize a strip, the strip is made to travel linearly along a longitudinal axis in the immediate vicinity in between a first set of two opposing arrays, i.e., in the flux gap between the arrays, and preferably in at least partial contact with each array, and more preferably in substantial contact with each array. By substantial contact it is meant that the lateral surface of the material touches both of the array set surfaces (i.e., having at least line contact with the top and the bottom array), or that it is in close enough contact given the magnitude of the flux that an effective flux transfer is achieved. The strip travels with a lateral face approximately perpendicular to the planar faces of the disks within the longitudinal axis generally parallel to the planar faces of the disks. The alignment along the direction of travel is carefully controlled so that the field lines are imprinted very precisely.

Further, in accordance with the present invention, the material is passed through two sets of arrays which are axially offset with regard to the alignment of the induced circumferential poles. Optionally a third axially set of arrays which is offset as a function of lateral distance could be used to optimize the residual induction as well as to control the "shape" of the induced poles as determined by a flux mapping technique.

Further, as an alternative embodiment of the present invention, the material passes from a set of magnetizing arrays to a biasing roller whereby the material is in contact with one of the arrays for a longer period and as a result, the material has a stronger magnetic bias on one surface than the other, i.e., is a non-traversing magnetized strip. This embodiment can be practiced independently of the offset set of arrays or in addition to this aspect of the invention.

It is an object of the invention to provide an apparatus and a process for producing a more strongly and efficiently magnetized magnetic material than from existing processes, i.e., material which more optimally utilizes the inherent magnetic characteristics of the pre-magnetized sample. Applications which utilize the product of the present invention include weather stripping and sealing, sign magnets, attractive and repulsive devices, motor applications and magnetic senders for sensing applications and the like. It is further an object of the invention to provide possible special shapes to the magnetized poles, i.e., other than the preferred nearly "square wave" shape for optimized pull strength. For example some motor designs may require flux "spikes" which can be located using a controlled method of sensing application and the like.

Another object of the invention is to provide an apparatus for the production of such magnetized material at high speeds, i.e., including speeds up to and over 200 ft. per minute. It is a further object of the invention to provide an improved non-traversing magnetic material, as well as an apparatus and process for the production of the material.

An additional object of the invention is to provide a device which can be easily modified for the production of both a non-traversing magnetized material or a traversing magnetized material.

BRIEF DESCRIPTION OF DRAWINGS

The invention will be better understood by means of the drawings which merely show particular non-limiting embodiments, and wherein.

DETAILED DESCRIPTION OF THE INVENTION

Figure 1:
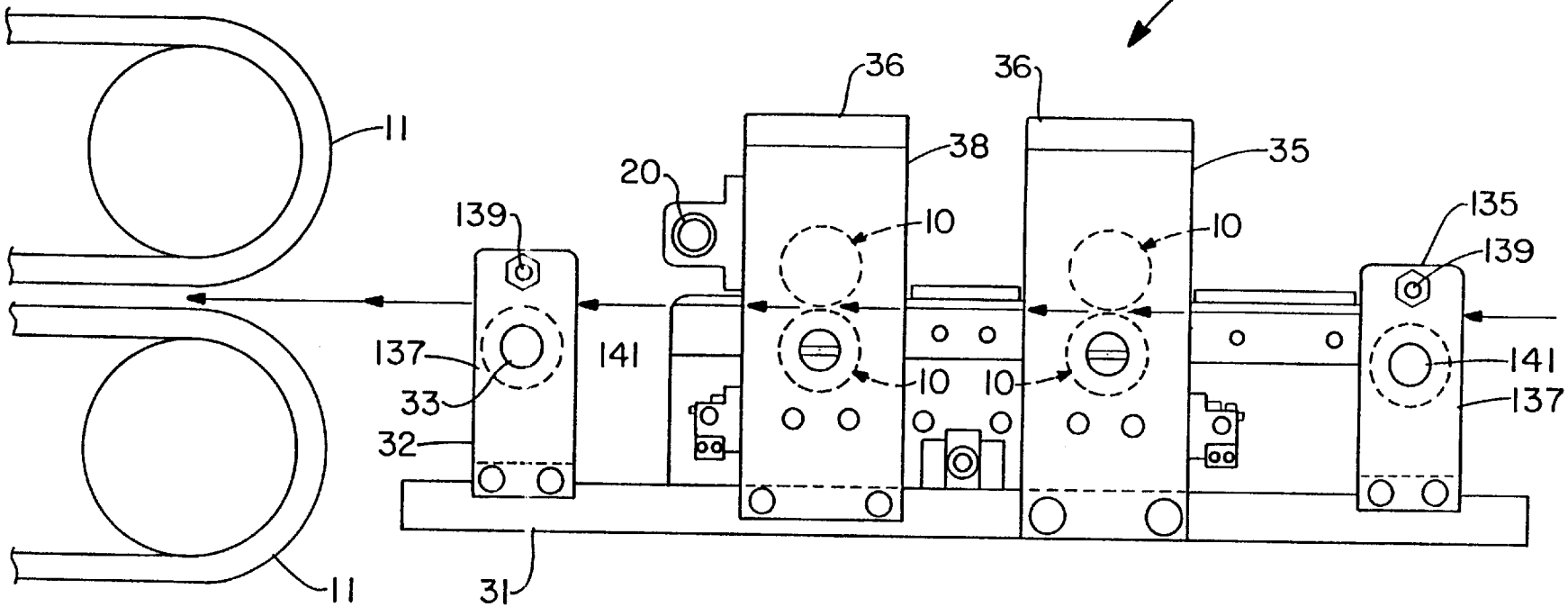
FIG. 1 is a side plan view of the apparatus in accordance with the invention set up for production of a traversing material.

The invention relates generally to a magnetized material realizing more of its magnetic potential as noted by its hysteresis properties, and to a process and an apparatus for the production of this magnetized material.

The material of the present invention generally comprises a polymeric binder or matrix which contains magnetic particles. It is further often advantageous that the matrix is a elastomeric or thermoplastic material such as, for example, rubbery compositions which can be made in appropriate configuration and which can accept appropriate loading of magnetic particles, specifically including chlorinated and chlorosulfonated polyethylene, polyisobutylene, nitrile rubbers, rubbers made from ethylene propylene and EPDM elastomers, ethylene vinyl acetate, acrylate elastomers and copolymers or blends based on the foregoing. However, the application of the invention need not be limited to any specific binder material and the selection will depend upon the ultimate application of the resulting material. Likewise, the invention is applicable to a broad range of magnetic fillers ranging from the low energy ferrite magnets, to the rare earth magnets, provided the intrinsic coercivity of the rare earth magnets is matched to the flux generated by the permanent magnetic disks. These fillers can be in the form of particles or powder as is appropriate. Specific example of suitable magnetic particles include hard ferrite magnets such as barium ferrite, strontium ferrite and lead ferrite, and low coercivity rare earth magnets. Typical loadings of these fillers are in the range of from about 50 percent to about 70 percent, more preferably from about 55 percent to about 65 percent by volume with the remaining percent being binder. Once again, the choice of the filler and the ratio of magnetic filler to matrix will depend upon the particular application for the product. Typically, the ferrite filler and loading will be selected so that the magnetic properties of the pre-magnetized ferrite material can be described as having a BhAX of from about 0.5 to about 1.6 MGOe; a Br of about 1,500 to about 2,600 G; a Hc of about 1,200 to about 2,300 Oe; a Hci of about 2,000 to about 4,000 Oe, taken through the thickness, i.e., perpendicular to the lateral face of the sample. The neodymium-boron iron ("NEO") magnets should be modified to a lower Hci of about 5,000 oersteds by compositional and process changes. The Delco melt spin process for NEO is optimum for providing particulate material to be used with the binder in the strips and sheets in accordance with the invention. Additives may be used as are known in the art including, for example, antioxidant, UV stabilizers, fungicides, antibacterial agents, and processing aids such as internal plasticizers and processing aids.

The non-magnetized material may be manufactured as is known in the art and according to the product application. In a preferred embodiment, the material is produced such as by calendering in sheet form or extrusion in strip form having a thickness ranging from about 0.010 inch to about 0.250 inch and over. Further, the material is generally planar and continuous on at least two parallel surfaces, although, it should be understood that a more complicated cross-section could be accommodated, such as, for example, a grooved or flanged configuration. In this case, magnetization would occur through an air gap at a grooved point, or perhaps more preferably by a mating configuration of the stacked magnetizing array.

The apparatus of the present invention acts to imprint magnetization on a non-magnetized material by generating a magnetic flux sufficient to cause technical saturation. The field generated through the flux conductor should be about three times the coercive field strength of the material to be magnetized. It is desirable to achieve technical saturation of the material in order to optimize the pull strength and other important magnetized qualities of the sample.

Suitable magnetic materials for the magnetic disks used in the array include rare earth alloys such as rare earth cobalt or iron alloys, with specific examples including samarium cobalt magnets and neodymium-iron-boron rare earth magnets, such as those sold by EEC (Electron Energy Corp.) and TDK. Particular materials include such products having an energy product (B-H) max exceeding 25 MGOe, and preferably over 27 MGOe; a residual induction, Br exceeding 10 kG, a coercive force of more than 10 kOe and an intrinsic coercive force $H_{ci}$ of more than 15 kOe.

Figure 7:
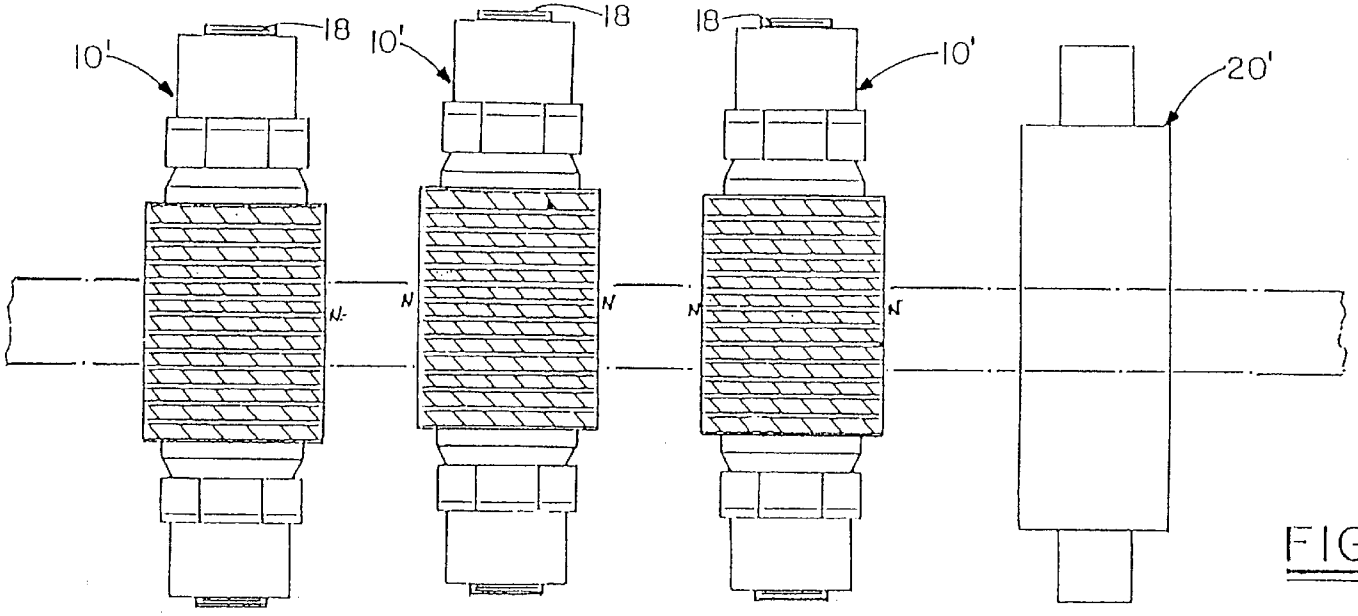
FIG. 7 is a top plan view showing a first, a second laterally offset set of arrays, and a third laterally offset set of arrays and a biasing roller.

It is particularly advantageous in the present invention, that the material is polarized with a multitude of alternating poles as is illustrated in FIG. 7, although it should be understood that the invention may apply to a sample which has only two opposing poles on a surface, or even to a sample which has a single pole with partial poles alongside on a surface.

A strip of magnetized material has multi-polar magnetization, it if has a succession of alternating south poles and north poles separated by neutral zones on the two faces in the width direction. If this arrangement is periodic, the distance between two adjacent poles defines the pole space or polar step of magnetization. In this case, the field lines traverse the thickness of the strip and are approximately perpendicular to the faces of the magnetic disks, i.e., they are parallel to the longitudinal axis and edges of the sample.

The material which is used for the flux conducting pieces can be considered a magnetically mild material. This material is preferably soft iron or an iron-cobalt alloy, but it is also possible to use permalloy, iron-nickel alloys, silicon, or carbon steel, or soft ferrites, depending on the magnetic permeability required. A particularly preferred material is vanadium permendur, which is an alloy of 49 percent iron and 49 percent cobalt, the remaining 2 percent being vanadium. An example of such is sold by Allegheny Ludlum Steel Corporation.

As previously discussed and as is illustrated in FIG. 1, a set 10 of magnetic arrays 12 is shown generally in FIG. 1. Each array comprises alternating series of uniform size magnetic disks 14 and generally uniform size flux conducting elements 15. The direction of magnetization of the magnetic disks 16 is axial with the poles being located at the circular faces of the disk. Two magnetic disks are generally situated on either side of one flux conducting pole element 15 with the directions of magnetization N-S being opposed. The disks 14 and the pole elements 15 are generally circular, preferably having a similar outer diameter so that a smooth continuous cylindrical surface 17 is. formed. The disks 14 and pole elements 15 further have a central hole so that the stacked array 12 is tightly journeled about the axle 18 and rotates without it. The axle 18 further carries a bushing 24 on either end for rotation relative to the apparatus. The arrays of disks 14 and elements 15 are held together mechanically, on the threaded arbor by a washer 20 and nut 27 which when tightened overcomes the magnetic repulsion of the magnetic disks. As the pole pieces serve to channel the magnetic flux produced by the opposing magnets towards the flux gap between the surfaces of the magnetizing medium, the north and south poles separated by neutral zones alternate. These polar moments are situated over the same width of the strip as the flux conductive elements and are situated at the point where the flux conducting contact pole pieces contact the surface of the magnetizing medium. There is also some flux loss to the inside diameter but this is usually a small percentage of the total flux generated.

Two opposing arrays are used together to form an array set (i.e., top and bottom arrays). The set contacts or at least effectively contacts either side of the material. The two arrays are placed in circumferential alignment so that the similar elements, i.e., magnetic disks or flux conducting pole elements of each array face each other and the directions of magnetization N-S of two facing main magnets are opposed to each other. The proximity of the opposing stack, and the opposing poles induces a flux circuit as previously described through the flux conducting pole elements. It is believed that the magnetic imprint is achieved when the material passes between the two stacks and completes the circuit. Thus, the material will be imprinted with a pole opposite from the surface contacting polar moment of the flux conducting pole element. Each array ends with a distal flux conducting element 15 on either side. The distal flux conducting elements have a thickness which is one half the thickness of the intermediate flux conducting elements 13. This assures that the intensity of the magnetic flux in these distal flux conducting elements will correspond with the intensity of the intermediate flux conducting elements.

Figure 14:
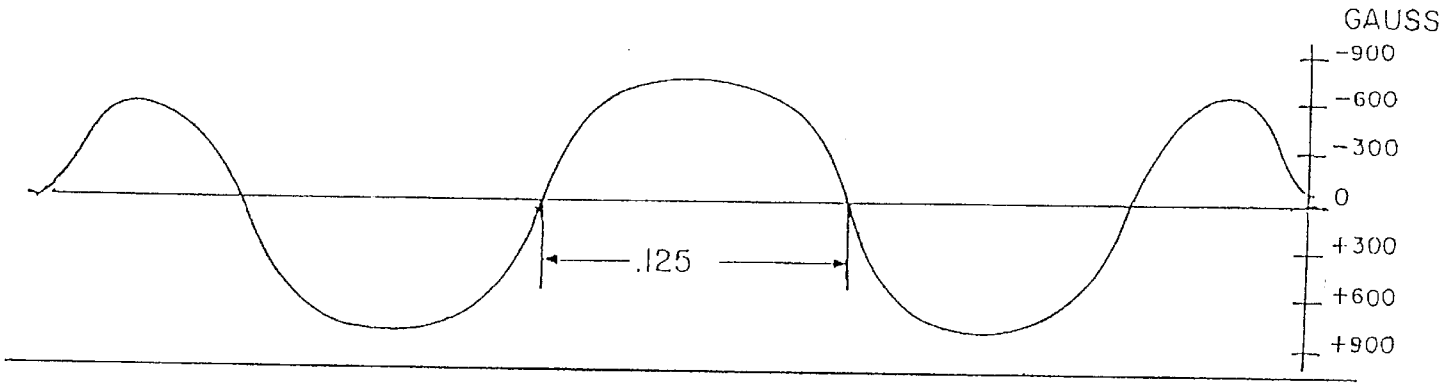
FIG. 14 is the original flux map of Br versus distance X across the lateral face of the sample for sample 3B with a steel backer.
Figure 15:
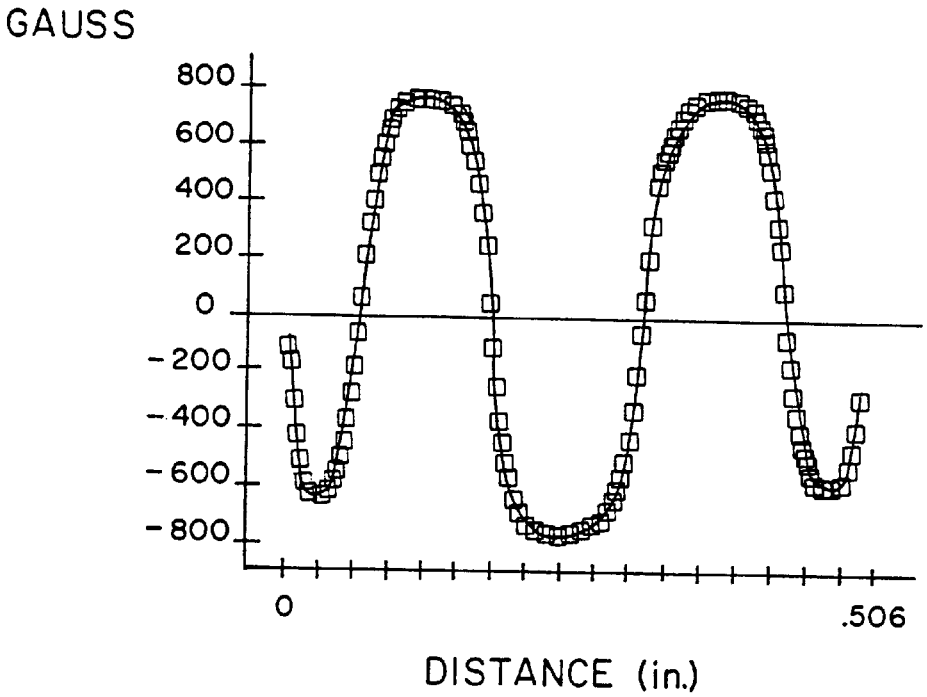
FIG. 15 is a digitized version of the flux map of FIG. 14 of Br versus distance X.
Figure 16:
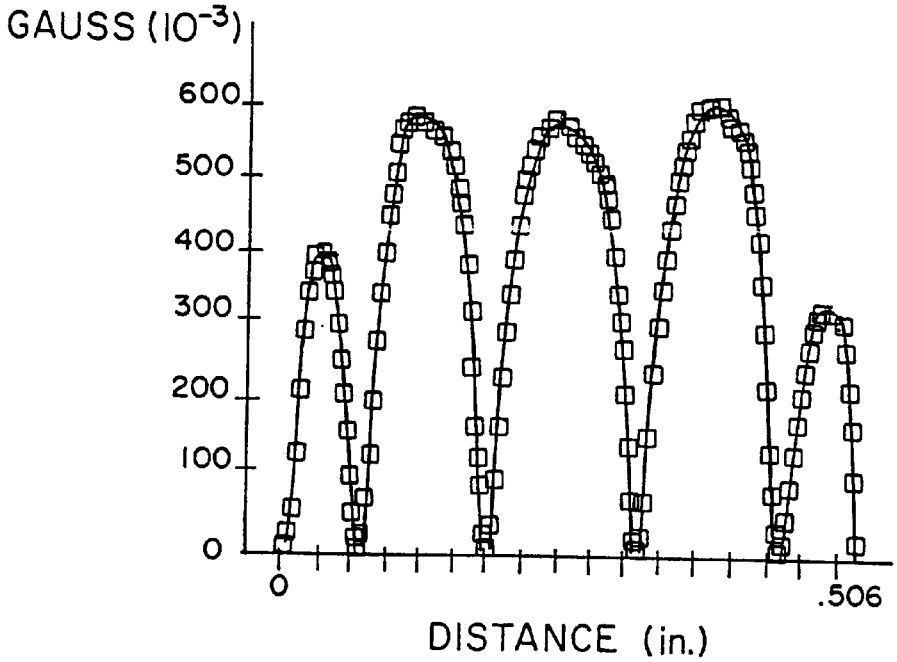
FIG. 16 is a plot biased on FIG. 15 of $Br^2$ versus distance X.
Figure 17:
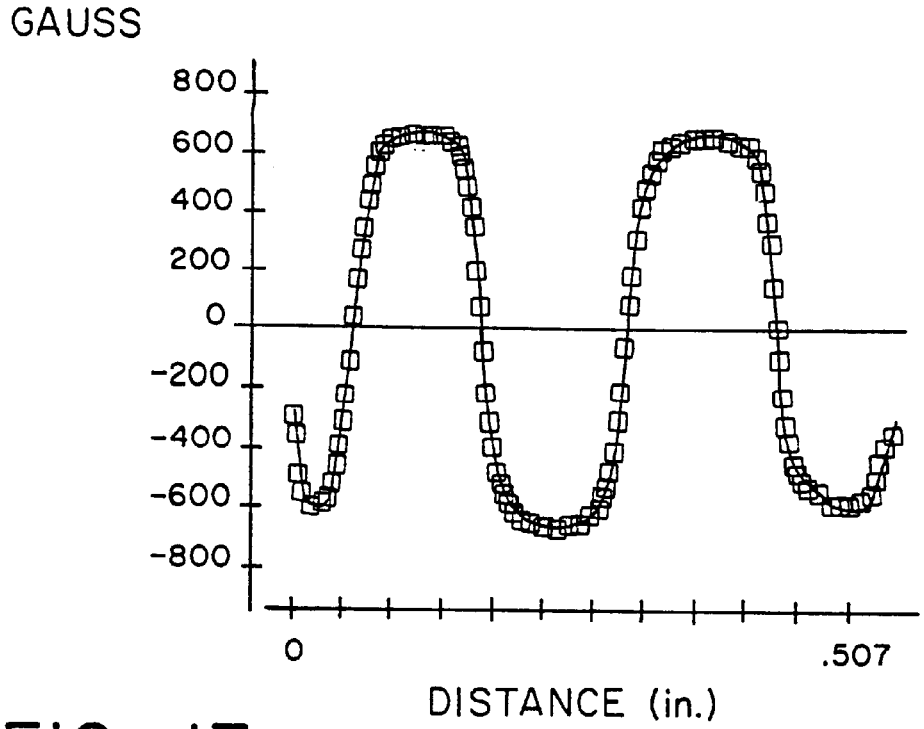
FIG. 17 is a digitized flux map of Br versus distance X across the lateral face of the sample for sample 3B without a steel backer.
Figure 18:
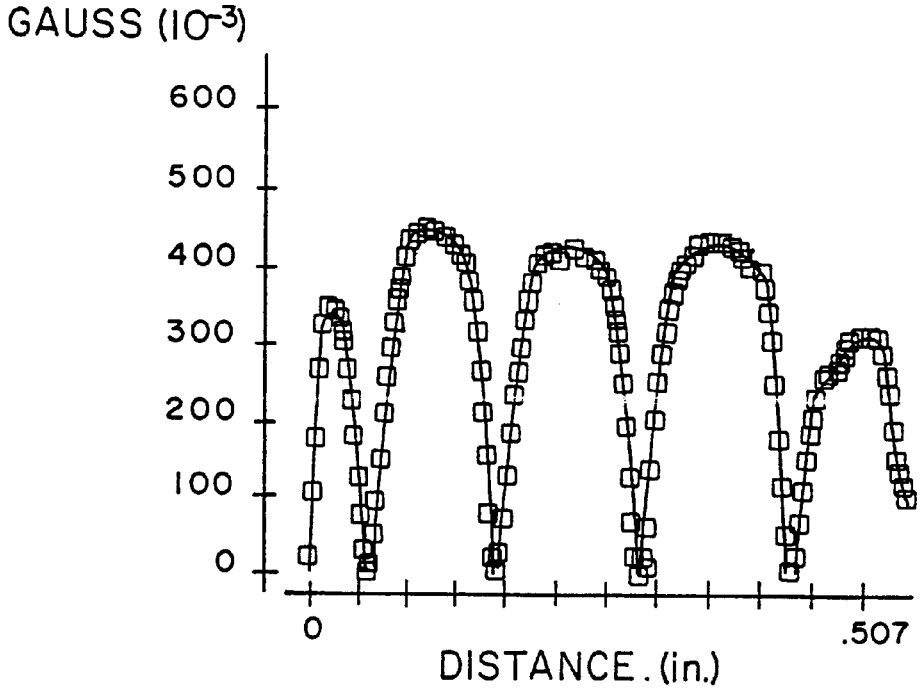
FIG. 18 is a plot based on FIG. 17 of $Br^2$ versus distance X.
Figure 19A:
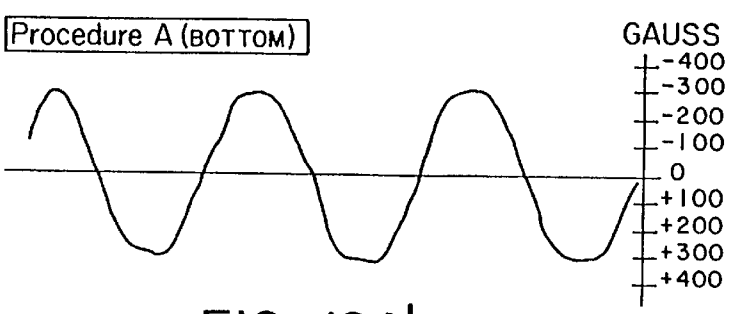
FIG. 19 is a series of flux maps plotting Br versus X for samples 1A, 1B and 1C for offset and bias for both the top and bottom of the samples.
Figure 19B:
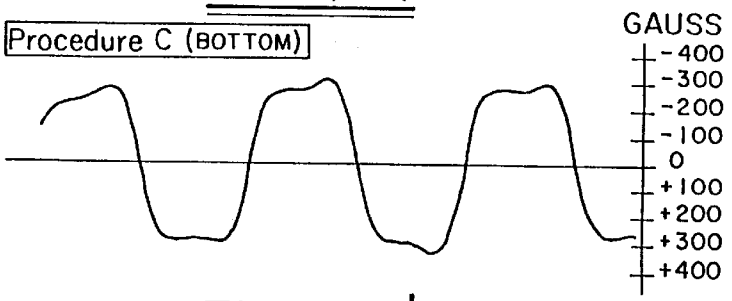
Figure 19C:
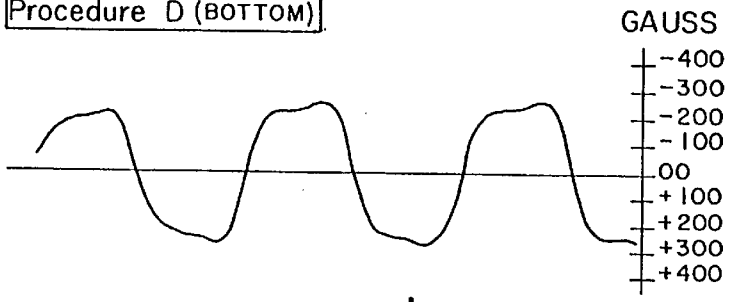
Figure 19A:
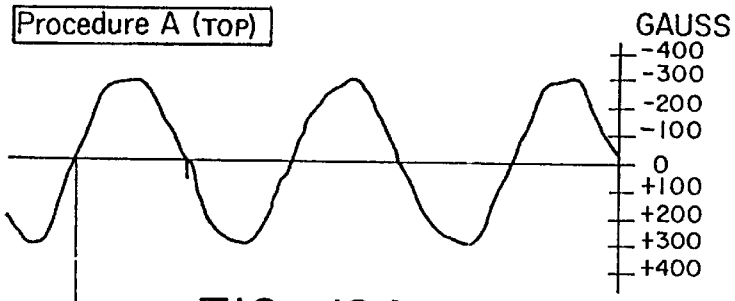
Figure 19B:
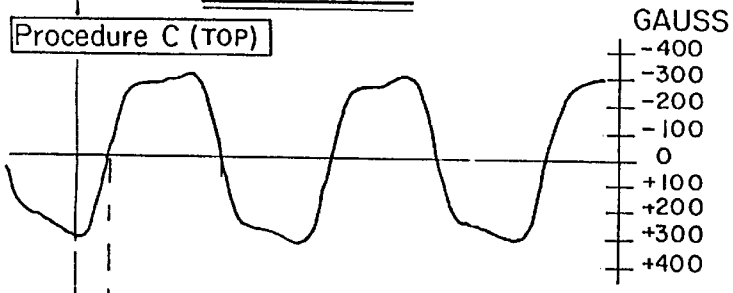
Figure 19C:
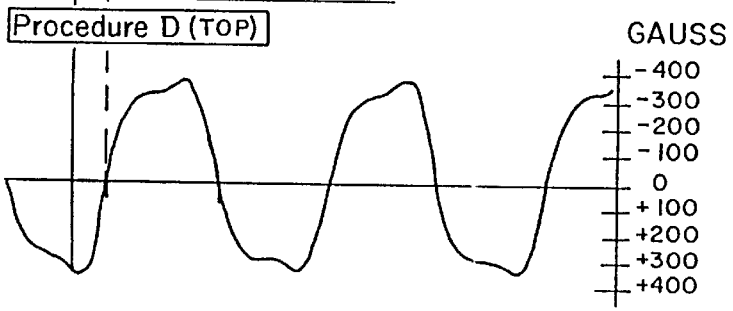

FIG. 14 shows the original contact flux map—Br versus distance of sample 3B of Example 3 having a steel "keeper." FIG. 15 shows a recreation of the same flux map as a result of digitizing on a X-Y table. In FIG. 16 the plot of FIG. 15 was converted into a plot of $Br^2$ versus lateral distance X across the surface of the sample. The total area under the $Br^2$ versus distance curve for the width of the sample is directly proportional to the contact pull strength measured when testing the breakaway force of that material from a cold rolled steel plunger . FIGS. 17–18 show the same digitized curves for sample 3B without a steel keeper. FIG. 19 shows the effect of no offset, one offset set of arrays by itself, as well as both offset arrays and bias takeoff on magnetization of a low energy relatively isotropic ferrite sheet (samples 1A, 1B, 1C of example 1)—both topside and backside flux maps are shown for these samples.

The stacked flux conducting pole elements and the magnetic disks have the shape of circular discs having an internal bore which receives a non-ferromagnetic axis to facilitate a cylindrical external surface of revolution. Depending on the circumstances, the arrays can be driving rolls or they can freely rotate about their axes.

The flux curves shown in FIGS. 14 through 19 demonstrate residual induction (Br) as a function of the lateral distance across the surface. This curve is related to the ultimate magnetic pull strength of the material. In fact, the pull strength is proportional to the square of Br with an optimal wave profile (also referred to as pole peak) from one pole to the next being rectangular, i.e. having a straight slope from maximum to minimum. FIG. 14 is the original flux map of Br versus distance. FIG. 16 is a graph of $BR^2$, residual induction, as a function of the lateral distance, x, across the surface of the sample for FIG. 15, with FIG. 15 illustrating a distilization of Br as a function of the distance.

The distalized graph is a plot of the measured Br using a traversing flux map probe Bell axial probe No. SAE 4-0608 being read through a Bell Model No. 620 gaussmeter. The probe is in substantial contact of the strip as it transverses the lateral face by substantial contact it means that there is less than a 0.005" of protective epoxy between the sensing loop and the sample. Since this traversing speed is slow, the scale of the X-axis is widely expanded.

It can be seen that the plots shown in FIG. 19 illustrate the improvement in magnetic properties which results from the present invention. Two pole spaces are illustrated in the solid line as the linear progression across the sample from node to node for the top and bottom of the sample. The X scale is expanded for the sake of clarity. The intersection of the X and the y axis represents the center of the 1st magnetic disk which contacted the sample, while the 1st peak, max Br, represents the center of the flux conducting pole piece. The second intersection with the y-axis represents the center of the 2nd magnetic disk which contacted the sample and the inverted peak, min Br, represents the center of the next flux conducting pole piece.

The polar profile in FIG. 19 illustrates the improvement of the invention. Specifically, the peak has been broadened, which would result in a significant increase in the area under the curve of $Br^2$ versus X. An inspection of the profile evidences a dual peak or polar shift in which the second peak is higher than the peak of the control sample. This second peak can be attributed to the second pass through a set of arrays, and the broadening is seen to be a result of the second set being axially offset with respect to the polar alignment of the first set. The axial distance that the second set should be offset is that distance which will cause the most significant increase in the integration of a plot of $Br^2$ versus X. Generally, through using either 1 or 2 offset passes in addition to the first set of arrays and using flux conductor to magnet thickness ratios of from 1 to 3.5 (i.e., from about 22.2 percent of total pole space covered by flux conductor) to about 1:1 (i.e., 50 percent of total pole space covered by flux conductor), it would be expected to have at least 66.6 percent pole coverage (22.2 percent×3 passes) from either 1 offset (2 imprints) or 2 offset (3 imprints) passes. Some of the total pole coverages of all the examples shown are shown in the summary of examples section. To this end, the offset is related to the width of the flux conducting element and to the width of the magnetic disks. It is usually optimal when the magnetic disk is from about 1 to about 3, and preferably about 1.5 to about 2.5 times the width or thickness of the flux conducting pole element. In this instance, when the sample is imprinted twice, it is preferable that the offset is equal to from about 0.5 to about 1.5 times the full width of a flux conducting element measured from the first edge of a full conducting element (of course, this assumes a uniform thickness for each flux conducting element and each magnetic disk, with the exception of the two end flux conducting elements which are ½ of the thickness in order to achieve a uniform flux concentration).

When the sample is imprinted three times, the first offset distance is equal to the width of the magnetic disk with a second axial offset distance being equal to about half of the width of the magnetic disk More simply, the offset shift for 1 pass offset (2 imprints) is usually the amount of the width of the flux conductor. The offset pattern for best results of 2 pass offset (3 imprints) is first offset shift to apparent outside of complete pole, second offset between first and second passes (apparent middle of pole). The optimal actual amount of offset can be calculated empirically. Since there will be some shifting of the second peak toward the original peak indicating that the material has a magnetic memory.

Figure 6:
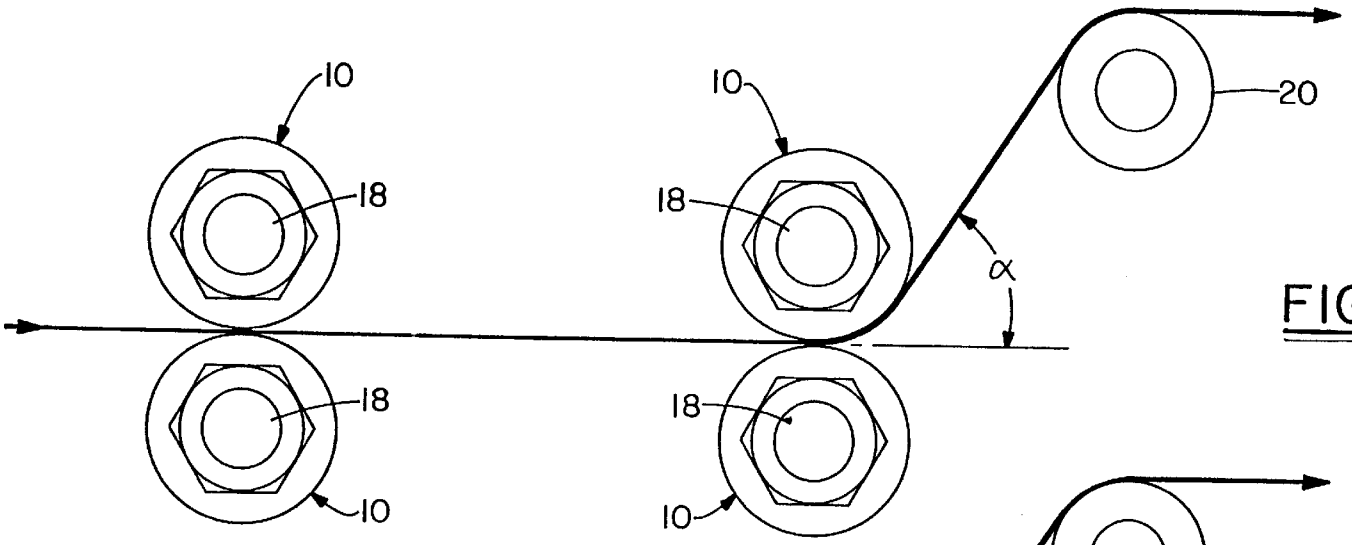
FIG. 6 is a side plan view showing a first and a second laterally offset set of arrays set of arrays and a biasing roller.
Figure 8:
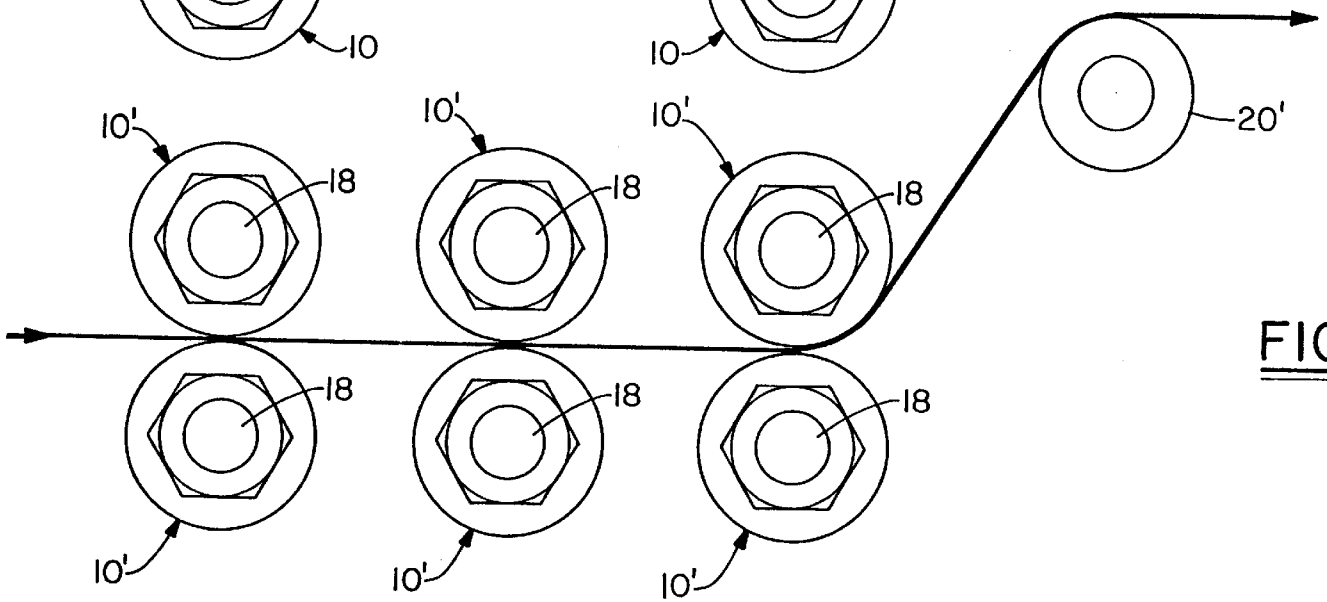
FIG. 8 is a side plan view showing a first, a second laterally offset set of arrays, and a third laterally offset set of arrays and a biasing roller.

In a second embodiment of the invention, the apparatus permits the production of biased (i.e., non-traversing) magnetization. This is accomplished by passing the material either from a sole set of arrays or alternately from the second, or offset array to a biasing roller. In this manner, the sample is held in contact with one of the two arrays for an additional period of time. The sample is pulled at an angle of from about 30° to about 90° and preferably from about 40° to about 80°, and most preferably from about 50° to about 70°, measured from the point at which the circumference and the shortest distance between the two arrays intersect to where the axis of the sample is tangential to the biasing roller. This angle is illustrated in FIG. 6.

A flux map corresponding to the top (and to the bottom) of a biased non-traversing sample is presented in FIG. 19 sample IC procedure D. It can be seen that the peaks are more intense for one side than the other such that the pull strength (i.e., the integration of $Br^2$ versus distance) would be greater on one side, i.e., the biased side, than for the other. These values are further confirmed with actual contact pull tests against the sample being attached to a magnetic cold rolled steel plunger. Results are included in the examples.

Moreover, in accordance with the invention, the apparatus can be used for either traversing or non-traversing magnetization with a simple adjustment of the take-up position of the sample. No modification is necessary. This aspect of the invention can be practiced independently of the first aspect, i.e. without the use of an offsetting set of arrays.

Figure 3:
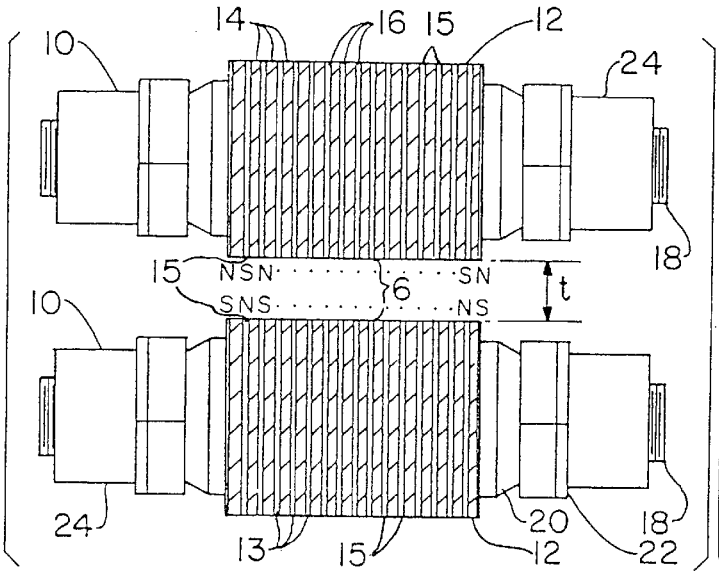
FIG. 3 is a front plan view showing a set of magnetic arrays.
Figure 4:
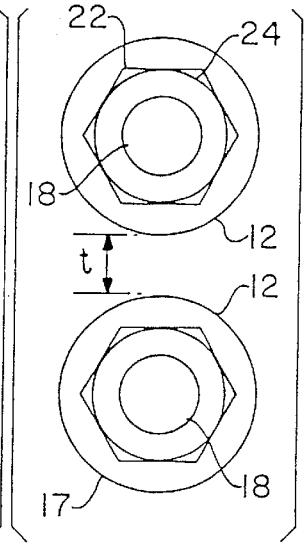
FIG. 4 is a side plan view showing a set of magnetic arrays.
Figure 5:
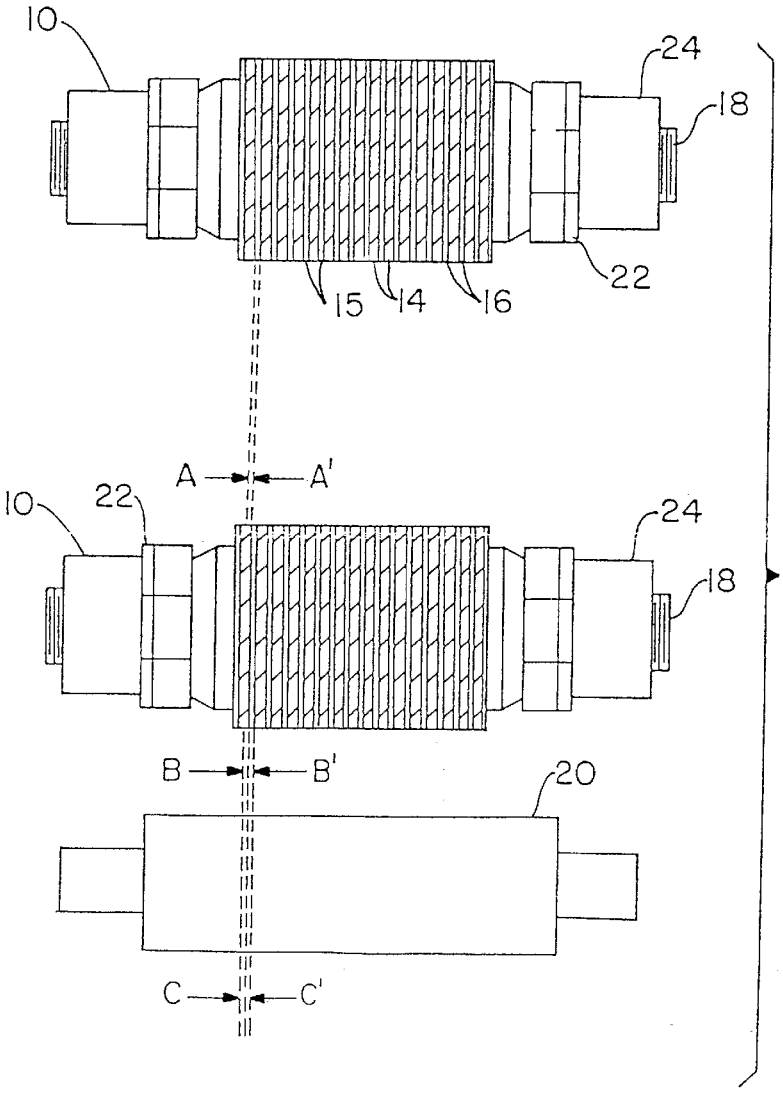
FIG. 5 is a top plan view showing a first and second laterally offset set of arrays and a biasing roller.

The device shown in FIGS. 3 and 4 comprises two stacks on their large faces of circular elements which are alternately permanent magnets made, for example, of a neodymium iron boron composition with a high coercive field, and induced flux and flux conducting pole elements having an induced flux and being made from, for example, of an iron cobalt alloy containing 49 percent of cobalt. The strip travels in a plane approximately parallel to the circular interfaces of the members of the stack or array. The two stacks define an air gap 6. Each magnetic disk 16 and each flux conducting pole 15 of one of the stacks is situated opposite a magnet and a pole piece of the other similar stack, respectively. Moreover, in the case of two facing magnets on either side of the air gap 6, the directions of magnetization oppose each other. This, therefore, produces in the air gap at right angles to the pole pieces, a succession of field lines in alternating directions, represented by the arrows which will imprint an alternating succession of north and south poles separated by neutral zones over the width of the strip 3 traveling in the air gap 6.

The stacks are formed by alternating elements, main magnets 14 and pole pieces 15 in the form of circular discs which are movable about an axis and have a cylindrical lateral surface and rotate at such a speed that the strip is prevented from sliding relative to the magnetizing medium. Further the strip is held in alignment by a interference type guide which abuts one lateral edge of the strip and which biases the strip into contact with the opposing lateral guide. These guides are made from a low-friction material to avoid where of the guide during use.

The offset array unit, i.e., the permanent magnet magnetizer fits into a slot in a base plate 1 and once the assembly has been positioned with the offset micrometer, it can be locked in place from under the base plate.

The device in accordance with the invention is shown in FIGS. 1–13. FIG. 1 is a side schematic illustrating a non-biased or non-traversing sample in which the sample exits a second set of arrays, i.e., the offset array station in substantially the same plane in which it enters. This is also true for the first set of arrays, i.e., the first array station. The first and second set are aligned so that the flux gap between the arrays are parallel and contact the plane of the top and bottom surfaces of the sample.

The device generally comprises a base plate 31, having an outboard roll stand 32 which supports an outboard roll 33. The base plate 31 further carries a main stand 35, an offset stand 38, and an inboard roll stand 135. Each of the stands comprise a basic four bar linkage including the base plate 31, lateral side elements 137, and in the case of the main stand 35 and the offset stand 38 including top plates 36. The linkage is closed on the inboard and outboard stands, 135, 32, respectively, by stabilizer bars 139. The inboard stand 135 further rotatably supports an inboard roll 141.

Each of the main stand 35 and offset stand 38 rotatably support a set or pair of opposing arrays 10 which have a bearing 24 that is journeled in a plastic bushing slot 141 to permit free rotation of the arrays 10 as the material is drawn through the device into a set of nip rollers 11. Of course it is evident that the bottom arrays will co-rotate as the material is drawn through. The sample is held in a lateral position relative to the arrays 10 to assure a proper and precise imprint (i.e., induction) of the poles by a lateral guide assembly 28 shown in FIGS. 10–13.

Figure 2:
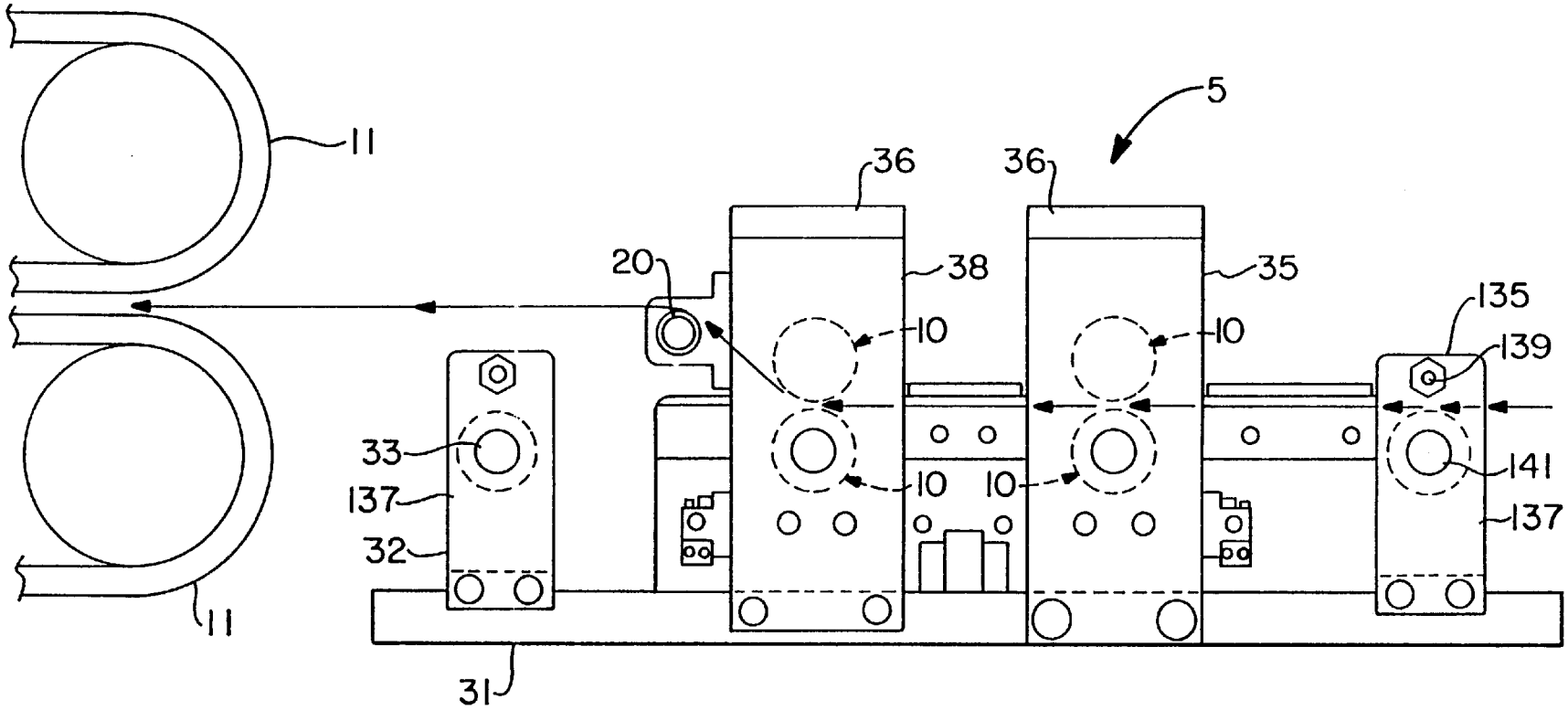
FIG. 2 is a side plan view of the apparatus in accordance with the invention set up for the production of a non-traversing material.

FIG. 2 illustrates a further embodiment in the present invention for non-traversing magnetization. In accordance with this aspect of the invention, the sample is biased to one of the arrays of the invention, and preferably, the sample is biased to one of the arrays of the final offset station. In particular, this is accomplished by passing the sample from the second array station to a biasing roller 20 which is located at an angle degree of from about 30° to about 90°, with a preferred angle being from about 40° to about 80°, and with a most preferred angle being from about 50° to about 70°. This angle is measured as the intersection of a line following the first path of travel along the longitudinal axis and a second line from the point on the circumference of the top offset making a chord with the circumference and passing tangentially to the bias roller 20. In order that the sample passes linearly from the bias roller 20 to the nip rollers 11, the entire permanent magnetization assembly 5 is lowered.

GUIDE SYSTEM

Figure 12:
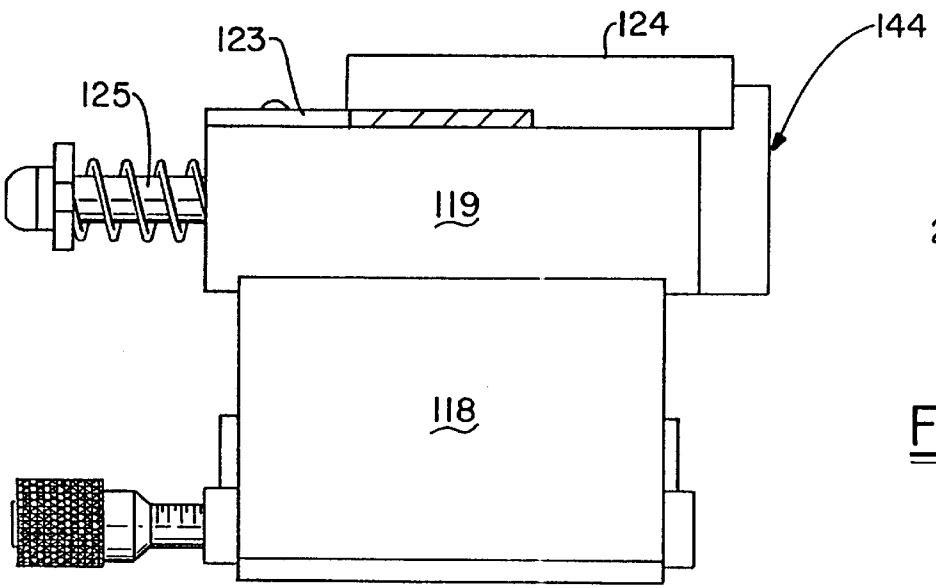
FIG. 12 is an end plan view of the guide system of FIG. 10.
Figure 13:
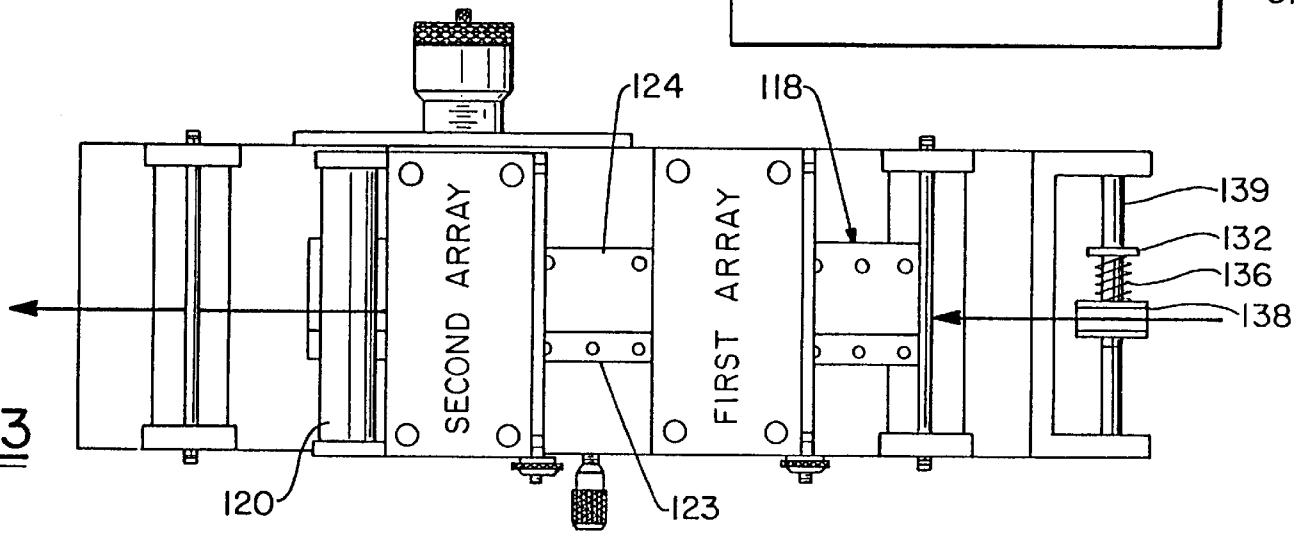
FIG. 13 is a top plan view of the permanent magnet magnetizer in accordance with the invention.
Figure 10:
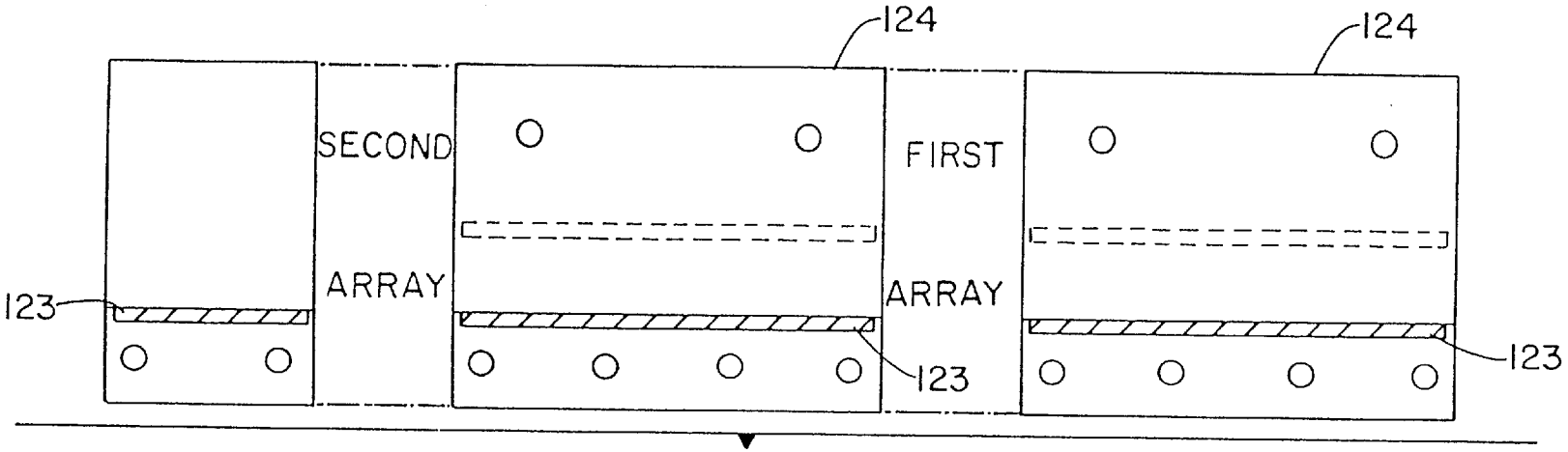
FIG. 10 is a top plan view of the guide system for use with the apparatus in accordance with the invention.
Figure 11:
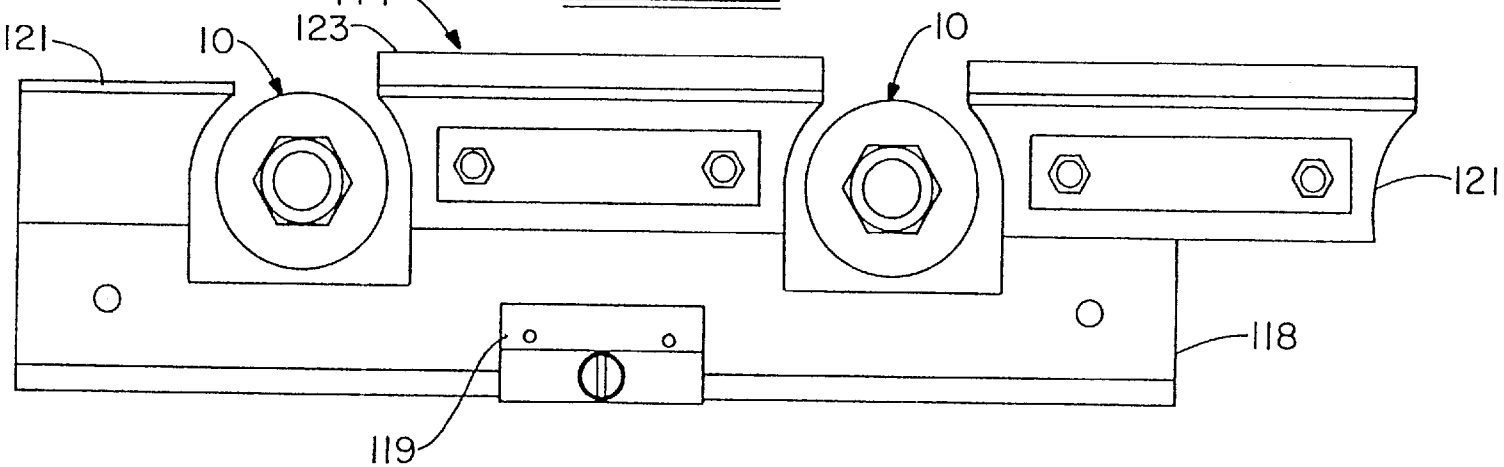
FIG. 11 is a side plan view of the guide system of FIG. 10.

The guide system 144 shown in FIGS. 11–13 consists of a main body assembly 118 which has special pads on the bottom to allow for easy positioning. This assembly is held in a yoke 119 that is positioned by a micrometer slide block 40. On top of body assembly 118 is a plastic guide block 121 (bed) which has been designed to fit around the lower roll in an array set up. A material, Ertalon, was selected because it is non-magnetic, and it can be precision machined, and it will not wear away easily. In order to accommodate various standard widths of strip, a fixed side guide 123 is used. This guide is attached on top of 121 and to the left. A suitable material for these guide plates is AMPCO 18 bronze with a carbide edge insert. A different set of guide plates is required for each width of material. Along with the fixed edge guide is a top guide 124 loaded in a lateral direction by a spring loader 125. The top guide 124 consists of an Ertalon block with a carbide insert on one edge. The assembly is fixed to the guide bed 114 and defines a channel which provides the means for precision alignment of the material in relation to the pole pieces in the arrays. It is evident that this type of guide system is an interference type of guide system.

Once the main guide has been positioned in relation to the edge of the material and the desired pole position, it can be secured with a split clamp on the four corners of the main guide block. Since the guide block is one piece, it assures very precise, and repeatable positioning. Both precision and repeatability are necessary to assure proper positioning of field lines in the sample and to achieve an optimal peak shape (i.e., pole wave of a flux map).

Along with the main guide system, there is also an external preguide 138. This comprises a double set of tapered AMPCO bronze guide wheels which are positioned on a rotating shaft 139, then locked down with a split collar. One of the bronze wheels has a tube extension 136 on it to allow the other (spring loaded wheel 132) to line up parallel and allow for width adjustments. Since this outboard guide is "free wheeling," another fixed roll is used to supply the necessary interference to make the guide work. The fixed roll is made of Teflon so the strip easily slips with a minimal amount of friction. Preguiding the material reduces the vibration which develops while running at high speeds, i.e., 200–240 fpm.

INTERFERENCE HEIGHT ADJUSTMENT

Figure 9:
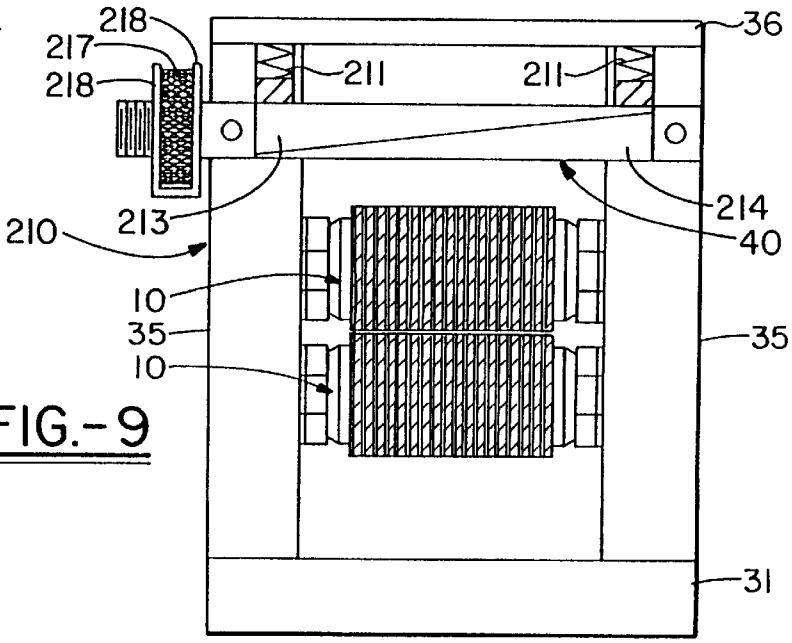
FIG. 9 is an end view of the height adjustment wedge in accordance with the invention.

FIG. 9 represents the wedge height adjustment 210 means to accomplish a height adjustment. This adjustment is necessary for several reasons. First, the upper array in an array set is spring loaded in order to assure sample contact and to protect the assembly and must be positioned for a proper interference with respect to the thickness of the material (compression springs 211 bias a block which bears against the bearing 24). Also, the attractive force of a 0.125" pole spacing array set is approximately 126# in$^2$, and this force can deform the thinner <0.060" material, causing the material to stretch in a linear direction, which not only changes precision imprint positioning, but the strip can also break at high speed operation.

The arrays 10 rotate in a non-magnetic stainless steel journal. An extension was added to one side on the upper corners of the array journals. These journals fit into a slotted stand 35, 38, with an extremely close tolerance fit, again to maintain alignment. Outbound of the side of the journal stand, a sliding wedge device 40 is used.

By design, there is a 0.018" gap built into the journal blocks between the arrays in an array set. This is to protect the arrays from banging together without any material in between. Allowing for that gap, the wedge supplies a precision method to set the height of one array relative to the other and maintain the proper interference to make intimate contact of the material with the rotating arrays.

The wedge consists of three pieces 213, 214. Often the apparatus in accordance with the invention must be disassembled, therefor, the aluminum base of the wedge has two ears which fit into a precision slot in the array set. Thus allows for automatic indexing of the wedge in relation to the journal extensions. The wedge itself is slotted on the bottom, which matches a raised section in the base to insure alignment and true travel in the wedge direction. AMPCO 18 bronze is used for the wedge because it is a very hard material. One end of the wedge has a left hand thread. A stainless round knurled nut 217 is placed on the threads and dropped between two upright sections 218 of the wedge base. By rotating the nut, the wedge is drive up or down the wedge base. By placing the nut in this yoke section of the base, a built-in locking mechanism is achieved, since the wedge will maintain its position at high speeds when it is loaded.

PRODUCTION SPEED

The invention was designed to run in-line in the production environment (i.e, post extruder). Normal production line speeds are 120–150 fpm, but the invention was designed to run at 240 fpm. After running almost 900,000 linear feet of various sizes of strip through the machine, no wear problems were found. Bearings were measured and found no measurable wear. The prototype runs showed that the invention is a high speed precision multi-pole magnetizer.

MATERIALS

Basically, all materials used to fabricate the invention are non-magnetic. Suitable metals used include non-magnetic stainless steel, aluminum, and bronze, even the bolts, screws and nuts are stainless steel. Parts of the guide system and bearing races are Ertalon, a PET type plastic. The carbide wear inserts in the guide system have the only non-magnetic material used. The carbide meets the abrasion resistance requirements and is only slightly attracted by magnetism.

Selection of the particular type of stainless steel was determined by the need for a tough non-magnetic material. Ertalon is an engineering plastic which lends itself to precision machining and provides gall free bearings for the array sets.

The results obtained using the process and the device according to the invention are illustrated by the following examples.

EXAMPLE 1

In accordance with Example 1 a sample of calendered flexible sheet having the dimensions, magnetic properties and particulate composition listing was magnetized. The binder was chlorosulfonated polyethylene and polyisobutylene, and the volume loading was about 60 percent. Three samples were run with the arrays set up as indicated and the magnetic properties are listed in Table I.

This example demonstrates the effect of both the offset (1B) and the offset plus bias (1C) on the shape of the induced poles (see flux map in FIG. 19) on a calendered elastomer sheet containing very low energy product ferrite particles (i.e., 0.55 MgOe). This sample utilizes a thin sheet (0.020") magnetized with 0.080" pole spacing. This can be compared with the control sample 1A. In particular, the effect of the invention is evident from the flux map, see FIG. 19. Furthermore, the influence of offset procedure on the shape of the poles and the influence of bias on the poles and the influence of bias on the flux density increase to the top side is dramatically shown in the flux maps and pull tests.

The polar shift and flux increase is significant and the resultant pull strengths shown in Table I verify the improvement over prior art, particularly for low energy (i.e., more isotropic) ferrite materials with no ferromagnetic (keeper) backer when measuring pull strength.

a steel backer plate (also termed a "keeper"— i.e., a plate which backs the flexible magnet). Procedure 2C was selected because of the equal strength 2-side requirement. Note that biased first set of arrays 2B had similar pull results with a steel keeper. Without the keeper, the biased and offset condition (2D) was considerably better in pull strength than the prior art control (2A). Both bias alone (2B) and offset alone (2C) show improvements, bias showing the better of the two for this pole spacing, material thickness and magnetic properties of the material. Sample 2E was magnetized the same as sample 2C with an improvement in pull strength—with steel keeper of $$\frac{265.3}{221.5} = 1.198$$

being roughly equivalent to the ratio of $$Br^2 \frac{21702}{2000^2} = 1.177$$

or ratio of energy product $$\frac{1.10}{.925} = 1.189.$$

TABLE I

PART MAGNETIZED

| | | Dimensions Magnetized | | Magnetic Properties Through Thickness | | | |
|---|---|---|---|---|---|---|---|
| Sample | Extruded Strip or Sheet | Width, In. | Thickness, In. | Br, g | Hc, Oe | Hei, Oe | BHmax, Mgoe |
| 1A | Calendered Sheet | 1.000 | .020 | 1500 | 1270 | 2180 | 0.55 |
| 1B | Calendered Sheet | 1.000 | .020 | 1500 | 1270 | 2180 | 0.55 |
| 1C | Calendered Sheet | 1.000 | .020 | 1500 | 1270 | 2180 | 0.55 |

MAGNETIZING PROCEDURE
1.250" OD × 0.500" ID ARRAYS

| Sample | Magnet Type | Magnet Thickness, In. | Flux Conductor Type | Flux Conductor Thickness, In. | Total Pole Spacing, In. | Array Set Up | Magnetized Pull Strengths-Contact w/steel Keeper psf | w/o keeper psf |
|---|---|---|---|---|---|---|---|---|
| 1A | ECC NEO 33 | .045 | Vanadium Permenaur | .035 | .080 | A | | Top 21.01 Bottom 19.85 |
| 1B | ECC NEO 33 | .045 | Vanadium Permenaur | .035 | .080 | C | N/R | Top 26.81 Bottom 24.80 |
| 1C | ECC NEO 33 | .045 | Vanadium Permenaur | .035 | .080 | D | N/R | Top 36.10 Bottom 19.60 |

EXAMPLE 2

This example was run using conditions indicated in Table II. This is an example of magnetizing an 0.090" thick× 0.500" (wide) extruded strip at 0.925 energy product (Br= 2000 g) and 0.250" pole spacing using all the procedures set forth in the array description except E. An object of the invention was to achieve equal strength on both sides with

KEY TO ARRAY SET UP

A. Pass through one array set only (See FIG. 5, position A—A).

B. Pass through one array set and bias to first array set towards top array.

C. Pass through one array set and pass through second array set offset the width of one flux conducting element measured from the first edge of the first full flux conducting element of the first array set (see FIG. 5, Position B–B').

D. Pass through one array set and a second array set offset as described in C. above and bias to second array set towards top array (see FIG. 5 position C—C).

E. Pass through one array set, pass through second array, array set offset 0.090 inch from the first edge of the first full flux conducting element, pass through a third array set offset 0.045 inch from the first edge of the first full flux conducting element and bias to third array set towards top array (see FIG. 7).

TABLE II

PART MAGNETIZED

| Sample | Extruded Strip or Sheet | Dimensions Magnetized: Width, In. | Dimensions Magnetized: Thickness, In. | Magnetic Properties Through Thickness: Br, g | Hc, Oe | Hei, Oe | BHmax, Mgoe |
|---|---|---|---|---|---|---|---|
| 2A | Extruded Strip | .505 | .089 | 2000 | 1745 | 2295 | .925 |
| 2B | Extruded Strip | .502 | .090 | 2000 | 1745 | 2295 | .925 |
| 2C | Extruded Strip | .506 | .089 | 2000 | 1745 | 2295 | .925 |
| 2D | Extruded Strip | .506 | .090 | 2000 | 1745 | 2295 | .925 |
| 2E | Extruded Strip | .506 | .090 | 2170 | 1950 | 2820 | 1.10 |

MAGNETIZING PROCEDURE
1.250" OD × 0.500" ID ARRAYS

| Sample | Magnet Type | Magnet Thickness, In. | Flux Conductor Type | Flux Conductor Thickness, In. | Total Pole Spacing, In. | Array Set Up | Magnetized Pull Strengths-Contact w/steel Keeper psf | w/o keeper psf |
|---|---|---|---|---|---|---|---|---|
| 2A | ECC NEO27 | .145 | Vanadium Permendur | .105 | .250 | A | 190.5 | 85.4 |
| 2B | ECC NEO27 | .145 | Vanadium Permendur | .105 | .250 | B | 221.1 | 109.9 |
| 2C | ECC NEO27 | .145 | Vanadium Permendur | .105 | .250 | C | 221.5 | 98.9 |
| 2D | ECC NEO27 | .145 | Vanadium Permendur | .105 | .250 | D | 217.5 | 115.0 |
| 2E | ECC NEO27 | .145 | Vanadium Permendur | .105 | .250 | C | 265.3 | N/R |

EXAMPLE 3

Table III shows a study on magnetizing 0.061" thick× 0.500 wide 0.76 MgOe extruded strip where 0.040/0.060= 0.100" pole space ("ps"), 0.035/0.090 or 0.050/0.075= 0.125" pole space, three different pole setups were selected, and two magnetizing procedures D & E. An object was to achieve 0.125" pole spacing and stronger pull strength to one surface with no steel keeper used. Bias was used on all setups. Sample 3A shows that respectable contact pull strength can be obtained with a narrower pole spacing 0.100" vs 0.125" (note that 0.100" is still much larger than the strip thickness of 0.060").

The procedure favored by and used in the production apparatus as 0.125" ps is noted as Sample 3C. This has somewhat lower pull strength than that achieved with Sample 3B, which requires an extra array set. On the other hand, the steel keeper backed pull strength is better with the magnetizing condition of Sample 3C. Conditions for Sample 3C were used for about 400,000–500,000 linear feet of production with precise pole position location.

Sample 3B illustrates the three array sets with the bias array setup (procedure E). This is shown in FIG. 7.

1) The original flux map directly off the chart of Br versus distance across sample is shown in FIG. 14 for the sample 3B with a steel backer. The digitized versions of FIG. 14 are shown as FIG. 15 as recorded on X-Y digitizer. FIG. 16 uses the digitizer plotting points of FIG. 15 to plot the graph of $Br^2$ versus distance across sample. For this sample, the area under the curve for the full width of the sample or summation $Br^2$ per 0.506"=327, 364 gauss$^2$. The actual pull strength for this sample (Table III)=165.2 PSF (pounds per square foot of sample).

2) The digitized versions of plots of Br versus distance across width and $Br^2$ versus distance across width for sample 3B with no steel keeper are shown in FIGS. 17 and 18 respectively. For this sample, the area under the curve for the full width of the sample or summation $Br^2$ per 0.507"= 267,346 gauss$^2$. The actual pull strength for this sample= 133.9 PSF, Therefore, ratio of summation $$Br^2 = \frac{327,364}{267,346} = 1.224$$

$$\text{ratio of actual pull strength} = \frac{165.2}{133.9} = 1.234$$

This illustrates the good correlation of summation $Br^2$ across the width with the pull strength of the samples.

The original flux map shown in FIG. 14 shows the pole shape when three imprints of pole arrays are used (procedure E) with the final imprint at the middle of the pole. This flux map shows the flux peak at the center as contrasted with the flux peak to one side with the two imprint offset procedures (procedure C and D) and shown in FIG. 19—samples 1B, 1C. This clearly indicates that the procedures can controllably offset the flux intensity shape within a pole.

TABLE III

| PART MAGNETIZED | | | | | | | |
|---|---|---|---|---|---|---|---|
| | | Dimensions Magnetized | | Magnetic Properties Through Thickness | | | |
| Sample | Extruded Strip or Sheet | Width, In. | Thickness, In. | Br, g | Hc, Oe | Hei, Oe | BHmax, Mgoe |
| 3A | Extruded Strip | .501 | .061 | 1830 | 1550 | 2430 | 0.76 |
| 3B | Extruded Strip | .506 | .062 | 1830 | 1550 | 2430 | 0.76 |
| 3C | Extruded Strip | .505 | .061 | 1830 | 1550 | 2430 | 0.76 |

EXAMPLE 4

Example 4 shows the effect of all one and two array set procedures (4A, 4B, 4C, 4D) on a relatively high energy (1.15 MgOe) 0.030" sheet. Again, this example illustrates both bias and offset improvements over the control (i.e., the prior art) without the stack keeper. It appears that both bias and offset have beneficial results compared to control (4A). See Table IV for conditions and results.

stationary sample at a given linear retraction rate, a pounds per square foot pull strength can be obtained not only for contact or breakaway pull, but also for pull strength at various air gaps from the magnet. Utilizing this test, we were able to determine the air gap at which the sample retains 50 percent of its contact pull strength and the air gap when it retains 25 percent.

TABLE IV

| PART MAGNETIZED | | | | | | | |
|---|---|---|---|---|---|---|---|
| | | Dimensions Magnetized | | Magnetic Properties Through Thickness | | | |
| Sample | Extruded Strip or Sheet | Width, In. | Thickness, In. | Br, g | Hc, Oe | Hei, Oe | BHmax, Mgoe |
| 4A | Sheet | .500 | .030 | 2200 | 1970 | 2550 | 1.15 |
| 4B | Sheet | .500 | .030 | 2200 | 1970 | 2550 | 1.15 |
| 4C | Sheet | .500 | .030 | 2200 | 1970 | 2550 | 1.15 |
| 4D | Sheet | .500 | .030 | 2200 | 1970 | 2550 | 1.15 |

MAGNETIZING PROCEDURE
1.250" OD × 0.500" ID ARRAYS

| Sample | Magnet Type | Magnet Thickness, In. | Flux Conductor Type | Flux Conductor Thickness, In. | Total Pole Spacing, In. | Array Set Up | Magnetized Pull Strengths-Contact w/steel Keeper psf | w/o keeper psf |
|---|---|---|---|---|---|---|---|---|
| 4A | ECC NEO33 | .045 | Vanadium Permendur | .045 | .090 | A | N/R | 101.3 |
| 4B | ECC NEO33 | .045 | Vanadium Permendur | .045 | .090 | B | N/R | 131.7 |
| 4C | ECC NEO33 | .045 | Vanadium Permendur | .045 | .090 | C | 217.4 | 114.6 |
| 4D | ECC NEO33 | .045 | Vanadium Permendur | .045 | .090 | D | 220.2 | 136.4 |

EXAMPLE 5

As shown in Table V, this example illustrates that a wide variety of pole spacings (¼", ⅓", ½") at various magnetic thicknesses and energies can be useful with this invention. These were magnetized equal strength on both sides (procedure C) and included the 0.127" thick strip with the best magnetic properties (1.55 MgOe, 2530 g Br, sample 5A). The maximum gauss reading between permendurs of an array set 0.127" apart (same as 5A thickness) was measured as 9300 gauss using a Bell Transverse probe HTL-0608. This is over 3 times the Hci of the 5A sample, which was 2890 Oe oersteds.

With such a variety of pole spacings illustrated by these examples and other samples in prior examples utilizing the procedure of this invention, it would be useful to know what "reach" of the magnetized samples had in relation to its contact pull strength as the air gap was increased.

By designing a pull tester which requires a cold rolled steel plunger, connected to a load cell, to retract from a This indicates a very strong correlation between pole spacing and retention of contact pull strength at various air gaps.

The 5C sample with a steel keeper had 0.520" pole spacing, a contact pull strength (CPS) of 335 PSF and retained 50 percent of CPS at 0.048" air gap and 25 percent of CPS at 0.104" air gap. The 5B sample with a steel keeper had 0.334" pole spacing, a contact pull strength (CPS) of 294.1 PSF and retained 50 percent of CPS at 0.028" air gap and 25 percent of CPS at 0.055" air gap. The 5A sample with a steel keeper had 0.250" pole spacing, a contact pull strength (CPS) of 356.0 PSF and retained 50 percent of CPS at 0.026" air gap and 25 percent of CPS at 0.051" air gap. The 3C sample without a keeper had 0.125" pole spacing, a contact pull strength (CPS) of 124.5 PSF and retained 50 percent of CPS at 0.014" air gap and 25 percent of CPS at 0.025" air gap. The 3A sample without a steel keeper had 0.100" pole spacing, a contact pull strength (CPS) of 128.7 PSF and retained 50 percent of CPS at 0.012" air gap and 25 percent of CPS at 0.023" air gap. The 1A (Top) sample without a steel keeper had a contact pull strength (CPS) of 36.1 PSF and retained 50 percent of CPS at 0.009" air gap and 25 percent of CPS at 0.017" air gap.

SUMMARY

In summary, the foregoing examples illustrate:

1) flexible magnet thickness from 0.020, (Examples 1A, 1B, 1C) to 0.248" (Example 5D).
2) flexible magnet energy products from 0.55 MgOe (Examples 1A, 1B, 1C) to 1.55 (Example 5A) MgOe.
3) flexible magnet Br ranging from 1500 g (Example 1A) to 2530 g (Example 5A).
4) flexible magnet Hc's from 1270 Oe (Example 1A) to 3930 Oe (Example 5C).
5) five magnetizing procedures as given in A, B, C, D, E including the three array set (Example 3B).
6) different pole spacings from 0.080 (Example 1A) to 0.520" (Examples 5C, 5D)
7) flux map pole shapes—sample 3B versus Examples 1B, 1C—that are illustrated from original graphs-FIGS. 14, 19.

In addition, Table VI illustrates the pole spacing makeup in terms of thickness of magnet (either EEC NEO27 or EEC NEO33) and thickness of flux conductor (vanadium permendur), expresses the flux conductor (FC) thickness as a percent of total pole thickness (pole spacing), then, with the number of imprints involved including offset passes, shows the total pole "coverage" of the FC passes in combination, including offset passes.

TABLE VI

POLE COVERAGE FOR 1.250" OD × .500" ID ARRAY SETS

| FC (Vanadium Permendur) In. | M (Neo) Width In. | Pole Spacing (FC + M) In. | 100FC/ FC + M % FC | Total No. of Passes | Total Coverage FC % | Series or Sample Number |
|---|---|---|---|---|---|---|
| .035 | .045[1] | .080 | 43.75 | 2 | 87.50 | 1A, 5C |
| .045 | .045[1] | .090 | 50.00 | 2 | 100.00 | 4A, B, C, D |
| .040 | .060[2] | .100 | 40.00 | 2 | 80.00 | 3A |
| .035 | .090[2] | .125 | 28.00 | 3 | 84.00 | 3B |
| .050 | .075[2] | .125 | 40.00 | 2 | 80.00 | 3C |
| .105 | .145[2] | .250 | 42.00 | 2 | 84.00 | 2A–2E, 5A |
| .134 | .200[2] | .334 | 40.00 | 2 | 80.00 | 5B |
| .220 | .300[2] | .520 | 42.30 | 2 | 84.60 | 5C, 5D |

[1]ECCNEO33, Br = 12,200 q, Hc = 10,600 Oe, Hci = >15,000 Oe, BHmax = 33.5 MgOe

[2]ALL OTHERS - ECCNEO27 Br = 10,800 g, Hc = 10,200 Oe, Hci = >15,000 Oe, BHmax = 27.5 MgOe

TABLE V

PART MAGNETIZED

| Sample | Extruded Strip or Sheet | Dimensions Magnetized Width, In. | Dimensions Magnetized Thickness, In. | Magnetic Properties Through Thickness Br, g | Hc, Oe | Hei, Oe | BHmax, Mgoe |
|---|---|---|---|---|---|---|---|
| 5A | Extruded Strip | 1.005 | .127 | 2530 | 2280 | 2890 | 1.55 |
| 5B | Extruded Strip | .992 | .092 | 2360 | 2080 | 3610 | 1.32 |
| 5C | Extruded Strip | .986 | .236 | 2320 | 2100 | 3930 | 1.27 |
| 5D | Extruded Strip | .972 | .248 | 1750 | 1440 | 2380 | 0.67 |

MAGNETIZING PROCEDURE
1.250" OD × 0.500" ID ARRAYS

| Sample | Magnet Type | Magnet Thickness, In. | Flux Conductor Type | Flux Conductor Thickness, In. | Total Pole Spacing, In. | Array Set Up | Magnetized Pull Strengths-Contact w/steel Keeper psf | w/o keeper psf |
|---|---|---|---|---|---|---|---|---|
| 5A | ECC NEO27 | .145 | Vanadium Permendur | .105 | .250 | C | 356.0 | 235.0 |
| 5B | ECC NEO27 | .200 | Vanadium Permendur | .134 | .334 | C | 294.1 | N/R |
| 5C | ECC NEO27 | .300 | Vanadium Permendur | .220 | .520 | C | 338.7 | 163.8 |
| 5D | ECC NEO27 | .300 | Vanadium Permendur | .220 | .520 | C | 191.8 | 114.9 |

While in accordance with the Patent Statutes, the best mode and preferred embodiment has been set forth, the scope of the invention is not limited thereto, but rather by the scope of the attached claims.

What is claimed is:

1. An apparatus for the magnetization of a material, said apparatus comprising a first set and a second set of arrays comprising a top magnetic array and a bottom magnetic array, said arrays each comprising at least two consecutive magnetic disks of equal thicknesses magnetized through the thickness and an intermediate flux conducting element between said two consecutive disks, said two consecutive disks being positioned with opposing like poles whereby a polar moment is induced at the circumferences of said flux conducting element and said top and said bottom magnetic array being aligned with opposite opposing polar moments, and said second magnetic array being axially offset from said first magnetic array.

2. An apparatus for magnetization as set forth in claim 1, said apparatus further comprising a biasing roller.

3. An apparatus for magnetization as set forth in claim 2, wherein said axial offset is equal to the thickness of said magnetic disk.

4. An apparatus for magnetization as set forth in claim 3, wherein each of said arrays has a series of intermediate flux conducting elements of a uniform thickness and has a distal flux conducting element on either side, each of said distal flux conducting elements having a thickness of about one half of the thickness of said intermediate flux conducting elements.

5. An apparatus for magnetization as set forth in claim 4, wherein said material is in the form of a strip and said material is longitudinally aligned in said apparatus by an interference guide system.

6. An apparatus for magnetization as set forth in claim 5, wherein said guide system is substantially comprised of a magnetically non-conducting material.

7. An apparatus for magnetization as set forth in claim 1, wherein at least one array of each set of arrays is biased mounted to define a gap through which said material passes.

8. An apparatus for magnetization as set forth in claim 7, wherein wedge height adjustment means are used to adjust the distance of said gap.

9. An apparatus for magnetization as set forth in claim 1, wherein said material is fed to said apparatus from an extruder.

10. An apparatus for magnetization as set forth in claim 1, wherein the components excluding the magnetic disks are substantially comprised of magnetically non-conductive material.

11. An apparatus for magnetization as set forth in claim 1, said apparatus further comprises a third set of arrays, axially offset from said first set.

* * * * *